United States Patent [19]

Geraedts

[11] 4,185,763

[45] Jan. 29, 1980

[54] CONTAINER WITH OVERWRAP

[75] Inventor: Joseph G. Geraedts, Agincourt, Canada

[73] Assignee: General Foods, Limited, Canada

[21] Appl. No.: 964,988

[22] Filed: Nov. 30, 1978

Related U.S. Application Data

[63] Continuation of Ser. No. 858,611, Dec. 8, 1977, abandoned, which is a continuation of Ser. No. 616,826, Sep. 25, 1975, abandoned.

[30] Foreign Application Priority Data

Jul. 4, 1975 [CA] Canada ..... 230827

[51] Int. Cl.[2] ..... B65D 03/24; B65D 05/48

[52] U.S. Cl. ..... 229/15; 229/90

[58] Field of Search ..... 229/15, 16 D, 27, 28 R, 229/29 R, 9, 10, 19, 90, DIG. 2, DIG. 11; 206/44 R

[56] References Cited

U.S. PATENT DOCUMENTS

| | | | |
|---|---|---|---|
| 1,102,191 | 6/1914 | Hammond | 229/9 |
| 2,654,472 | 10/1953 | White | 229/90 |
| 3,076,589 | 2/1963 | Meijdam | 229/34 R |
| 3,425,615 | 2/1969 | Wood | 229/15 |
| 3,473,654 | 10/1969 | Zimmerman | 229/15 |
| 3,543,991 | 12/1970 | George et al. | 229/15 |

FOREIGN PATENT DOCUMENTS

| | | | |
|---|---|---|---|
| 1394755 | 11/1963 | France | 229/90 |
| 339564 | 8/1959 | Switzerland | 229/9 |

*Primary Examiner*—Davis T. Moorhead

*Attorney, Agent, or Firm*—Alan Swabey; Robert Mitchell; Guy Houle

[57] ABSTRACT

A container including a shipping carton in combination with a plurality of joined display trays. The shipping carton includes an open-ended sleeve. Each modular display tray has an end wall, side walls and a short front wall, and an array of trays is provided wherein each tray in the array is joined along its side walls to adjacent trays.

6 Claims, 7 Drawing Figures

CONTAINER WITH OVERWRAP

This is a continuation of application Ser. No. 858,611 filed Dec. 8, 1977, which in turn is a continuation of Ser. No. 616,826, filed Sept. 25, 1975, and both is now abandoned.

BACKGROUND OF THE INVENTION

1. Field of the Invention

The present invention relates to a container, and more particularly, to a container suitable for shipping, storage and useful as a display tray for displaying the consumer goods carried therein.

2. Description of the Prior Art

In the marketing of grocery products, there is considerable competition between manufacturers of similar grocery items, in the area of space allocation on display shelves in various grocery stores, particularly the large supermarkets. This competition extends to the prominence of the display area allocated which includes a factor of proper shelf level as well as the width or actual area on the shelf which is allocated. In order to obtain the desired display width, grocery products manufacturers have at times presented an integral wide display tray having a plurality of divided rows in which the grocery product has been stored so as to force the store to allocate a predetermined width to the particular item. However, such devices have not always proved satisfactory. For instance, different stores, depending on their size, could handle proportionally different amounts of a particular brand name product and, therefore, different size display cartons would have to be cut and set up to predetermined sizes to accommodate from two to five rows of the grocery product to be put on display, depending on the capacity of the store in question. Economy of box construction is also compromised since the display tray and dividers may be made up of a plurality of separate blanks.

SUMMARY OF THE INVENTION

It is an aim of the present invention to provide a display tray which is made up of a plurality of identical modular display units joined together in a predetermined selected number.

It is a further aim of the present invention to provide a display tray made up of a plurality of modular units with a sleeve wrapped or fitted about the joined display units for shipping and storing purposes.

It is a still further aim to provide a combined display tray made up of modular display units joined together in a selected number associated with a sleeve to form a shipping container with improved stacking strength.

A construction in accordance with the present invention includes a container comprising a plurality of joined modular display units, wherein each unit includes at least a bottom wall and side walls, and said units being joined along their side walls in an array.

In a further more specific construction of the present invention, there would be provided a sleeve adapted to be wrapped about the array of display units forming the tray, and the sleeve being co-extensive therewith.

In a still further more specific aspect of the present invention, the sleeve and the modular units would be made from a corrugated cardboard with the corrugations running in a direction parallel to a plane normal to the longitudinal axis of the array of units such that when the combined tray and sleeve are stored, the corrugated cardboard construction of the units and the sleeve provide a suitable stacking force.

In a still further more specific aspect of the present invention, there is provided a bundling strap extending across the open ends of the sleeve and about a pair of opposed longitudnal walls of the sleeve.

The present construction lends itself to simplified and also to automated operations as opposed to the manual setting up of display trays to date. It is also found that in certain circumstances during storage, for instance, that the shipping container, including the display units, must withstand very high stacking loads, and the present combination as described above would meet such requirements, especially if the display modules are made of corrugated cardboard with the corrugations running in the vertical direction of the eventual normal position of the trays when the containers are being stacked. For instance, in a preferred use of these trays, small flat flexible pouches containing granular material are provided in the display units. In the storing position, it is preferred that the units be set up so that they are sitting on their back wall such that the pouches are lying flat in the trays as opposed to being supported on their edges as they would be in a display position. Furthermore, in stacking load considerations, the gluing together of the side walls of individual modular display units provides double wall partitions or dividers which act as load-bearing walls when the containers are stacked.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

The container 10 includes an outer sleeve 12 and an assembled display tray 14. The display tray 14 is made up of individual modular units 16.

Figure 6:
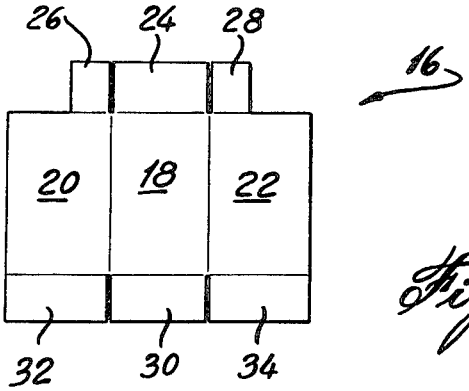
FIG. 6 is a blank used to make the individual tray modules.

Each unit 16 is made up from the blank shown in FIG. 6. The blank includes a bottom wall panel 18 and side wall panels 20 and 22. The front wall is made up of reinforcement flaps 26 and 28 and the flap 24 hinged to the central bottom wall flap 18. The rear wall is made up of a flap 30 hinged to the central panel 18 and flap 32 and flap 34 are hinged to the panels 20 and 22 respectively.

For purposes of stacking the container when it is assembled, it is preferable that the corrugations 48 run in a direction vertical to the eventual stacking position. Accordingly, depending on the type of packages to be stored and displayed in the modular units 16, it may be preferable to stack the display trays such that the individual modular units 16 extend with the side walls 20, 22 and bottom wall 18 in vertical planes while the front wall 24 and bottom wall 30 are in horizontal planes. In such a situation, it would be preferable that the corrugations run in a direction longitudinal of the blank panels 18 and 22 as well as throughout the flaps. However, the units 16 might be designed to be stacked with the walls 20, 22 in vertical planes and the bottom wall 18 in a horizontal plane while the front wall 24 and rear wall 30 are in vertical planes. Then it would be best that the corrugations run in directions transverse to the longitudinal axis of the panels 20, 18 and 22.

The blank of the individual modular unit 16 can be set up by automatic machinery. The modular units 16 would then be located side-by-side in the number of units which are required for a predetermined display array. This could be anywhere from a single unit 16 to five and more.

Figure 1:
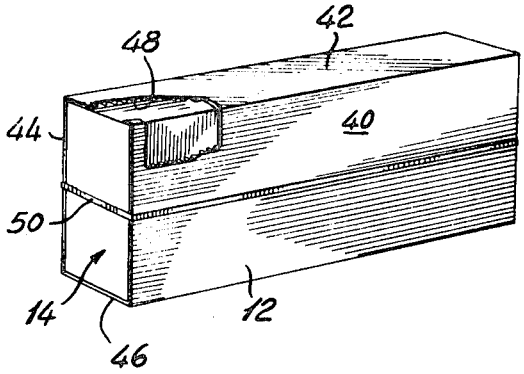
FIG. 1 is a perspective view of the container.
Figure 2:
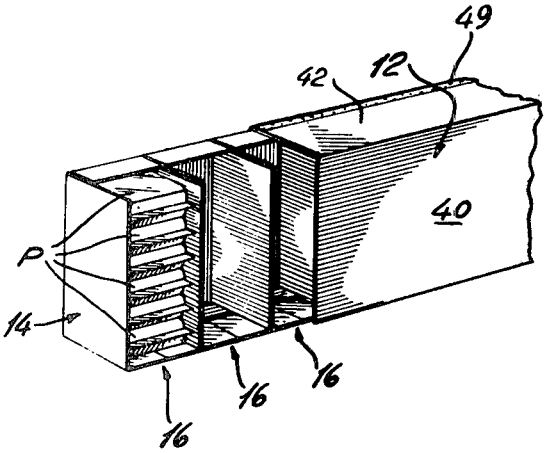
FIG. 2 is a fragmentary perspective view showing the container of FIG. 1 with the display trays partially removed.
Figure 3:
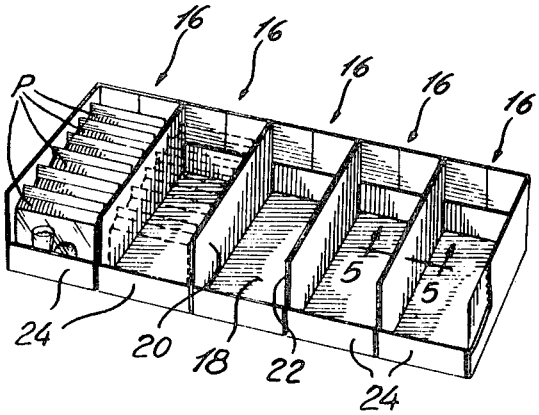
FIG. 3 is a perspective view of the display trays without the outer sleeve.

Accordingly, no custom-made manufacture of the blank would be necessary to suit different store capacities. It would simply be necessary to monitor the width necessary in any particular store and select the number of units 16 which are to be attached together in an array to form a display tray 14. The display tray 14 of the illustrated embodiment is used for transporting and displaying flexible transparent pouches containing four individual flexible envelopes or pouches P containing granulated crystallized fruit drinks. It is preferable, during the storing and transporting of the envelopes P, that the envelopes P be laid flat in order to reduce leakage such that the display units 16 have their longitudinal axis in a vertical axis as shown in FIG. 2. Accordingly, as described above, the corrugations in the display units 16 would run in a direction longitudinal of the side walls 20 and 22.

Figure 4:
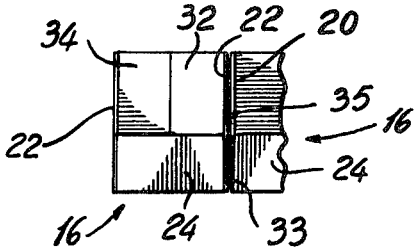
FIG. 4 is a fragmentary front elevation.

Each unit 16 which is adhered to an adjacent unit 16 is first treated with a suitable cold glue 35 on the outside of the panel 20 or 22. It is then pressed with an adjacent modular unit 16 and a hot melt 33 is applied at spots on walls 20 and 22 so as to hold the modules together while the cold glue 35 between the walls 20 and 22 of the adjacent display units 16 is setting, as shown in FIG. 4.

The sleeve 12 can have four panels 40, 42, 44 and 46. One longitudinal joint of the panel can be secured by means of a strippable tape 49. The sleeve 12 would have its corrugations 48 in the longitudinal direction of the blank, that is, in a plane transverse to the longitudinal axis of the assembled container, such that when the combination of the display tray 14 is within the sleeve 12 and is being stacked, the corrugations 48 of the panels 40 and 44 preferably would be in the vertical direction.

A further bundling type tape 50 is used for closing the ends of the sleeve and thereby securing the display tray 14 within the sleeve. The bundling tape 50 can be made of nylon or other suitable plastics material, such as polypropylene. The tape 50 also helps to contain the package in a single unit thereby enhancing the stacking strength of the package.

When the container reaches the store, the store attendant breaks the bundling tape 50 and removes the strippable tape 49 thereby exposing the display tray. The display tray 14 is then placed on the shelf with the longitudinal axis of each individual unit 16 in a horizontal plane such that the pouches P extend vertically within the units 16.

Figure 7:
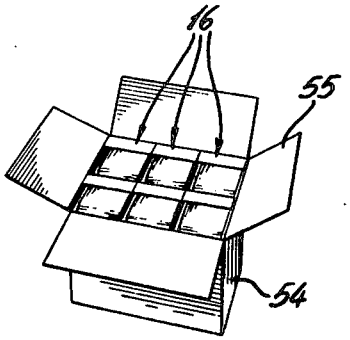
FIG. 7 is a perspective view of a further embodiment of the container.
Figure 5:
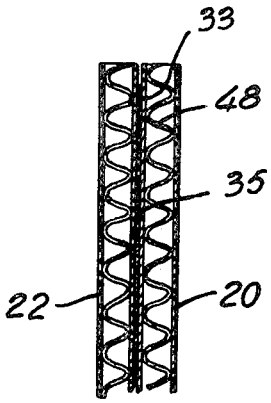
FIG. 5 is a fragmentary cross-sectional view taken along line 5—5 of FIG. 3.

In a further embodiment, there is shown in FIG. 7 a container wherein the trays 16 are in arrays of three and located in an outer corrugated container, in rows of two. The outer container 54 includes conventional flaps 55 on either end thereof for closure and shipping. The stacking strength of the package 54 with the display units 16 therein would be very high.

The corrugations of the outer container 54 would run transverse of the blank such that they are vertical when the container is set up as shown in FIG. 7. The corrugations of the display unit would be as described above.

I claim:

1. A combined shipping and display tray assembly of predetermined depth and width dimensions and adapted to contain flexible packages arranged upright in a plurality of parallel rows, an array of identical modular tray units, each tray unit having a bottom wall, integral side walls of uniform depth at least equal to the depth of said packages, a rear wall and a front wall of a depth less than the depth of said packages, said side, rear and front walls extending from the bottom wall at right angles thereto forming from a single tray unit blank a self-contained modular display unit, each unit having depth and length dimensions equal to the depth and width dimensions of said tray respectively and the length of said tray being a multiple of the width of each tray unit, each unit being attached along its side wall to the side wall of an adjacent unit forming the display tray, and adapted to supportively contain a row of said packages prior to being so attached, and a removable overwrap extending about the display tray forming a closed, stackable, load-bearing, shipping container with the display tray.

2. A display tray assembly as defined in claim 1, wherein the side walls of the individual units are attached to each other by means of suitable glues.

3. A display tray assembly as defined in claim 1, wherein said overwrap is in the form of a sleeve provided about the array forming the tray with walls of the sleeve being co-extensive with the margins of the display tray.

4. A display tray assembly as defined in claim 3, wherein the sleeve is made up of sheet material having a corrugated structure with the corrugations running parallel to a plane transverse to a longitudinal axis of the display tray such that the corrugations extend vertically in at least two walls of the sleeve when the container is being stored so as to enhance the stacking strength thereof.

5. A display tray assembly as defined in claim 1, wherein the display units have load-bearing side walls, and each side wall has an area substantially equal to the cross-sectional area of the formed shipping container such that the individual side walls of the display units lend load-bearing and stacking strength to the shipping container so formed.

6. A display tray assembly as defined in claim 5, wherein the display units are made up of individual corrugated sheet material from a single blank with each blank including a central panel forming the floor of the display unit, a flap connected to the central panel to form the front wall of the unit, a pair of opposed flaps on either side of the central panel forming the side walls, a further flap formed on the remaining edge of the central panel to form a portion of the rear wall, a pair of flaps, one at each upper edge of the side wall flaps so as to adhere to the first rear wall flap to form the rear wall, corrugations of the sheet material forming the blank running longitudinally of the central panel and parallel thereto in the flaps thereof such that when the display unit is formed in an array to form a display tray and is secured within a sleeve and the container is to be ultimately stored with the display units standing on their rear walls, the corrugations extend vertically in the side walls.

* * * * *

UNITED STATES PATENT AND TRADEMARK OFFICE

CERTIFICATE OF CORRECTION

PATENT NO. : 4,185,763

DATED : January 29, 1980

INVENTOR(S) : JOSEPH G. GERAEDTS

It is certified that error appears in the above-identified patent and that said Letters Patent are hereby corrected as shown below:

Correct the inventorship as follows:

[75] Inventors: Joseph G. Geraedts, Agincourt, Gordon Hewson, Cobourg, both of Canada Signed and Sealed this

*Twentieth* Day of *May 1980*

[SEAL]

*Attest:*

SIDNEY A. DIAMOND

*Attesting Officer*

*Commissioner of Patents and Trademarks*